US005930747A

United States Patent [19]

Iijima et al.

[11] Patent Number: 5,930,747

[45] **Date of Patent: *Jul. 27, 1999**

[54] PITCH EXTRACTION METHOD AND DEVICE UTILIZING AUTOCORRELATION OF A PLURALITY OF FREQUENCY BANDS

[75] Inventors: Kazuyuki Iijima, Saitama; Masayuki Nishiguchi, Kanagawa; Jun Matsumoto, Kanagawa; Shiro Omori, Kanagawa, all of Japan

[73] Assignee: Sony Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/788,194

[22] Filed: Jan. 24, 1997

[30] Foreign Application Priority Data

Feb. 1, 1996 [JP] Japan ..... 8-016433

[51] Int. Cl.[6] ..... G10L 9/08

[52] U.S. Cl. ..... 704/207; 704/217

[58] Field of Search ..... 704/207, 217, 704/208

[56] References Cited

U.S. PATENT DOCUMENTS 3,617,636 11/1971 Ogihara ..... 704/207

*Primary Examiner*—David R. Hudspeth
*Assistant Examiner*—Harold Zintel
*Attorney, Agent, or Firm*—Jay H. Maioli

[57] ABSTRACT

A pitch extraction method and apparatus whereby the pitch of a speech signal having various characteristics can be extracted accurately. The frame-based input speech signal, band-limited by an HPF 12 and an LPF 16, is sent to autocorrelation computing units 13, 17 where autocorrelation data is found. The pitch lag is computed and normalized in the pitch intensity/pitch lag computing units 14, 18. The pitch reliability of the input speech signals, limited by the HPF 12 and the LPF 16, is computed in elevation parameter calculation units. A selection unit 20 selects one of the parameters obtained from the input speech signal, limited by the HPF 12 and the LPF 16, using the pitch lag and the evaluation parameter.

20 Claims, 6 Drawing Sheets

PITCH EXTRACTION METHOD AND DEVICE UTILIZING AUTOCORRELATION OF A PLURALITY OF FREQUENCY BANDS

BACKGROUND OF THE INVENTION

1. Field of the Invention

This invention relates to a method and device for extracting the pitch from an input speech signal.

2. Description of the Related Art

Speech is classified into voiced speech and unvoiced speech. The voiced speech is the speech accompanied by vibrations of vocal chords and is observed as periodic vibrations. The unvoiced speech is the speech not accompanied by vibrations of vocal chords and is observed as non-periodic noise. In usual speech, voiced speech accounts for the majority of the speech, while the unvoiced speech is made up only of special consonants termed unvoiced consonants. The period of the voiced speech is determined by the period of the vibrations of the vocal chords and is termed the pitch period, while its reciprocal is termed the pitch frequency. The pitch period and the pitch frequency represent main factors governing the pitch or the intonation of the speech. Therefore, extraction of the pitch period accurately from the original speech waveform (pitch extraction) is crucial throughout the process of analyzing and synthesizing the speech for speech synthesis.

As a method for the pitch extraction, there is known a correlation processing method exploiting the fact that the correlation processing acts against waveform phase distortion. An example of the correlation processing method is an autocorrelation method, according to which, in general, the input speech signal is limited to a pre-set frequency range and subsequently the autocorrelation of a pre-set number of samples of the input speech signal is found in order to extract the pitch and in order to obtain the pitch. For band-limiting the input speech signal, a low-pass filter (LPF) is generally employed.

If, in the above-mentioned autocorrelation method, the speech signal containing pulsed pitch in the low frequency components is used, the pulsed components are removed by passing the speech signal through an LPF. Thus it is difficult to extract the pitch of the speech signal passed through the LPF in order to obtain the correct pitch of the speech signal containing the pulsed pitch in the low-frequency components.

Further, another problem exists in which if the speech signal containing the pulsed pitch in the low-frequency components, in which the pulsed low-frequency components are not removed, is passed through only a high-pass filter (HPF), and if the speech signal waveform is a waveform containing a large quantity of noise, the pitch and noise components become hardly distinguishable from each other, such that the correct pitch again cannot be obtained.

SUMMARY OF THE INVENTION

It is therefore an object of the present invention to provide a method and device for pitch extraction whereby the pitch of speech signals having various characteristics can be extracted correctly.

With the pitch extraction method and apparatus according to the present invention, an input speech signal is limited to a plurality of different frequency bands. From the autocorrelation data of a pre-set unit for the speech signal of each frequency band, the peak pitch is detected in order to find pitch intensity and the pitch period. Using the pitch intensity, an evaluation parameter specifying the pitch intensity reliability is computed and, based on the pitch period and the evaluation parameter, the pitch of the speech signal of one of the plurality of different frequency bands is computed. This enables the pitch of speech signals of various characteristics to be extracted accurately to assure high precision pitch searches.

DESCRIPTION OF THE PREFERRED EMBODIMENTS

Figure 1:
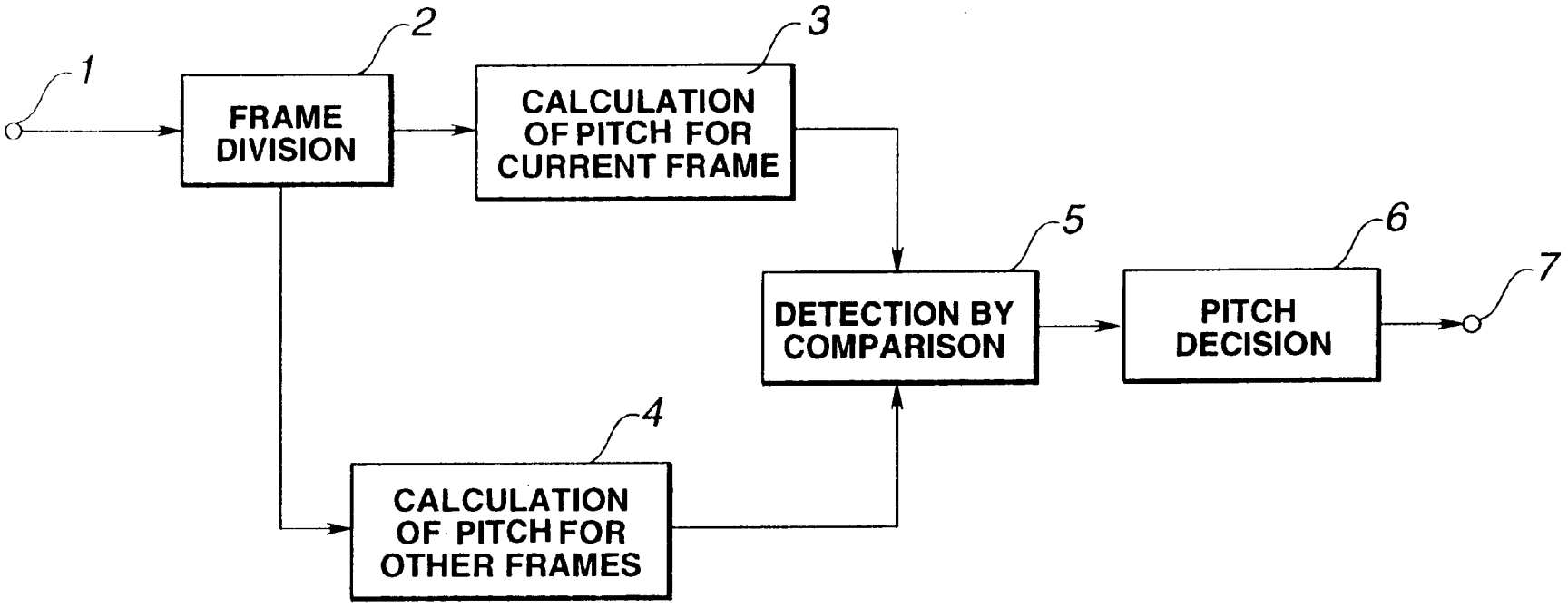
FIG. 1 schematically illustrates an embodiment of a pitch search device employing a pitch extraction device according to the present invention.

Referring to the drawings, preferred embodiments of the present invention will be explained in detail.

Figure 2:
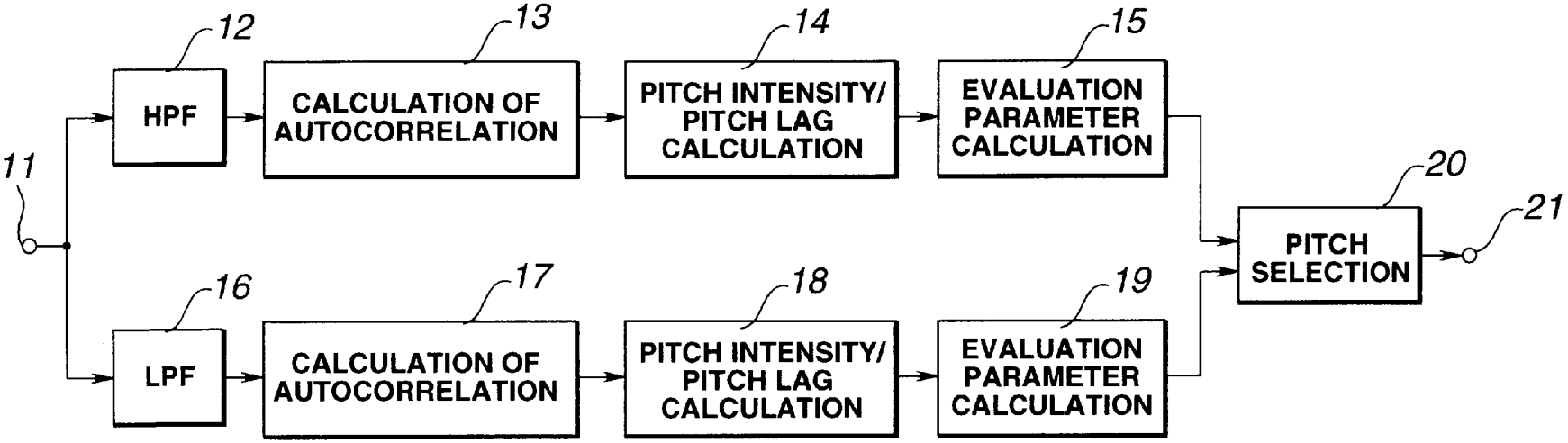
FIG. 2 schematically illustrates a pitch extraction device according to the present invention.

FIG. 1 schematically illustrates the structure of a pitch search device employing a pitch extraction device according to one embodiment of the present invention, while FIG. 2 schematically illustrates the structure of the pitch extraction device according to the one embodiment of the present invention.

The pitch extraction device shown in FIG. 2 includes an HPF 12 and an LPF 16, as filter means for limiting an input speech signal into frequency bands of different frequencies and autocorrelation computing units 13, 17, as autocorrelation computing means for computing autocorrelation data of pre-set units for each of the speech signals of the respective frequency bands from the HPF 12 and the LPF 16. The pitch extraction device also includes pitch intensity/pitch lag computing units 14, 18, as pitch period computing means for detecting the peak from the autocorrelation data from the autocorrelation computing units 13, 17 for finding the pitch intensity for computing the pitch period, and evaluation parameter computing units 15, 19 as evaluation parameter computing means for computing the evaluation parameters specifying the reliability of the pitch intensity using the pitch intensity from the pitch intensity/pitch lag computing units 14, 18. The pitch extraction device also includes a pitch selection unit 20, as pitch selection means for selecting the pitch of the speech signal of one of the frequency bands of the speech signals of the plurality of different frequency bands.

The pitch search device of FIG. 1 is now explained.

The input speech signal from an input terminal 1 of FIG. 1 is sent to a frame division unit 2. The frame division unit 2 divides the input speech signal into frames each having a pre-set number of samples.

A current frame pitch computing unit 3 and another frame pitch computing unit 4 compute and output the pitch of a pre-set frame, and are each comprised of a pitch extraction device shown in FIG. 2. Specifically, the current frame pitch computing unit 3 computes the pitch of the current frame divided by the frame division unit 2, while the other frame pitch computing unit 4 computes the pitch of a frame other than the current frame as divided by the frame division unit 2.

In the present embodiment, the input signal waveform is divided by the frame division unit 2 into, for example, the current frame, a past frame and a future frame. The current frame is determined based on the determined pitch of the past frame, while the pitch of the current frame is determined based on the pitch of the past frame and the future frame. The concept of correctly computing the pitch of the current frame from the past, current and future frames is termed the delayed decision method.

A comparator/detector 5 compares the peak as detected by the current frame pitch computing unit 3 to the pitch as computed by the other frame pitch computing unit 4 to determine whether or not the detected and the calculated pitch satisfy a pre-set relation, and detects a peak if the pre-set relation is met.

A pitch decision unit 6 decides the pitch of the current frame from the peak as obtained on comparison/detection by the comparator/detector 5.

The processing for pitch extraction in the pitch extraction device of FIG. 2 constituting the current frame pitch computing unit 3 and the other frame pitch computing unit 4 is specifically explained.

The frame-based input speech signal from an input terminal 11 is sent to each of the HPF 12 and the LPF 16 for limitation to two frequency bands.

Specifically, if the input speech signal having the sampling frequency of 8 kHz is divided into 256-sample frames, the cut-off frequency $f_{ch}$ of the HPF 12 for band-limiting the frame-based input speech signal is set to 3.2 kHz. If an output of the HPF 12 and an output of the LPF 16 are xH and xL, respectively, the outputs xH and xL are limited to 3.2 to 4.0 kHz and to 0 to 1.0 kHz, respectively. This, however, does not apply if the input speech signal was band-limited previously.

The autocorrelation computing units 13, 17 find the autocorrelation data by fast Fourier transform (FFT) to find respective peaks.

The pitch intensity/pitch lag computing units 14, 18 re-array the peak values in the decreasing order by way of sorting by pitch intensity. The resulting functions are denoted rH(n), rL(n). If the total numbers of peaks of autocorrelation data as found by the autocorrelation computing unit 13 and that as found by the autocorrelation computing unit 17 are denoted by $N_H$ and $N_L$, respectively, rH(n) and rL(n) are denoted by the equations (1) and (2), respectively:

$$rH(0), rH(1), \ldots, rU(N_H-1) \quad (1)$$

$$rL(0), rL(1), \ldots, rL(N_L-1) \quad (2)$$

The pitch lags for rH(n), rL(n) are computed as $lag_H(n)$, $lag_L(n)$, respectively. This pitch lag denotes the number of samples per pitch period.

The peak values of rH(n) and rL(n) are divided by rH(0) and rL(0), respectively. The resulting normalized functions r'(n), r'(n) are represented by the following equations (3) and (4):

$$1.0 = r'H(0) \geq r'H(1) \geq r'(H)(2) \geq \ldots \geq r'H(N_H-1) \quad (3)$$

$$1.0 = r'L(0) \geq r'L(1) \geq r'(L)(2) \geq \ldots \geq r'L(N_L-1) \quad (4)$$

The largest values or peak values among the re-arrayed r'(n) and r'(n) are r'(0) and r'(0).

The evaluation parameter computing units 15, 19 compute the pitch reliability probH of the input speech signal band-limited by the HPF 12 and the pitch reliability probL of the input speech signal band-limited by the LPF 16, respectively. The pitch reliability probH and probL are computed by the following equations (5) and (6), respectively:

$$\text{probH}=r'H(1)/r'H(2) \quad (5)$$

$$\text{probL}=r'L(1)/r'L(2) \quad (6)$$

The pitch selection unit 20 judges and selects, based on the pitch lags computed by the pitch intensity/pitch lag computing units 14, 18 and on the pitch reliability as computed by the evaluation parameter computing units 15, 19, which of the parameter obtained by the input speech signal band-limited by the HPF 12 or the parameter obtained by the input speech signal band-limited by the LPF 16 should be used for pitch search of the input speech signal from the input terminal 11. At this time, judgment operations according to the following Table 1 are carried out:

TABLE 1

| |
|---|
| If lagH × 0.96 < lagL < lagH × 1.04 then use parameter by LPF |
| else if $N_H$ > 40 then use parameter by LPF |
| else if probH/probL > 1.2 then use parameter by HPF |
| else use parameters by LPF. |

In the above judgment processing operations, the processing operations are carried out so that the pitch as found from the input speech signal band-limited by the LPF 16 will be higher in reliability.

First, the pitch lagL of the input speech signal band-limited by the LPF 16 is compared to the pitch lag lagH of the input speech signal band-limited by the HPF 12. If the value of lagH is smaller than lagL, the parameter obtained by the input signal band-limited by the LPF 16 is selected. Specifically, if the value of the lagL by the LPF 16 is larger than a value equal to 0.96 times the pitch lag lagH by the HPF 12, and smaller than a value equal to 1.04 times the pitch lag lagH, the parameter of the input speech signal band-limited by the LPF 16 is used.

Next, the total number $N_H$ of the peaks by the HPF 12 is compared to a pre-set number and, if $N_H$ is larger than a pre-set number, judgment is given that the pitch is not sufficient, and the parameter by the LPF 16 is selected. Specifically, if $N_H$ is 40 or higher, the parameter of the input speech signal band-limited by the HPF 12 is used.

Then, probH from the evaluation parameter computing unit 15 is compared to probL from the evaluation parameter computing unit 19 for judgment. Specifically, if a value obtained on dividing probH by probL is 1.2 or larger, the parameter of the input speech signal band-limited by the HPF 12 is used.

If judgment cannot be given by the above-described three-stage processing operations, the parameter of the input speech signal band-limited by the LPF 16 is used.

The parameter selected by the pitch selection unit 20 is outputted at output terminal 21.

The sequence of operations for pitch search by the pitch search unit employing the above-described pitch extraction device will now be explained by referring to the flowcharts of FIGS. 3 and 4.

Figure 3:
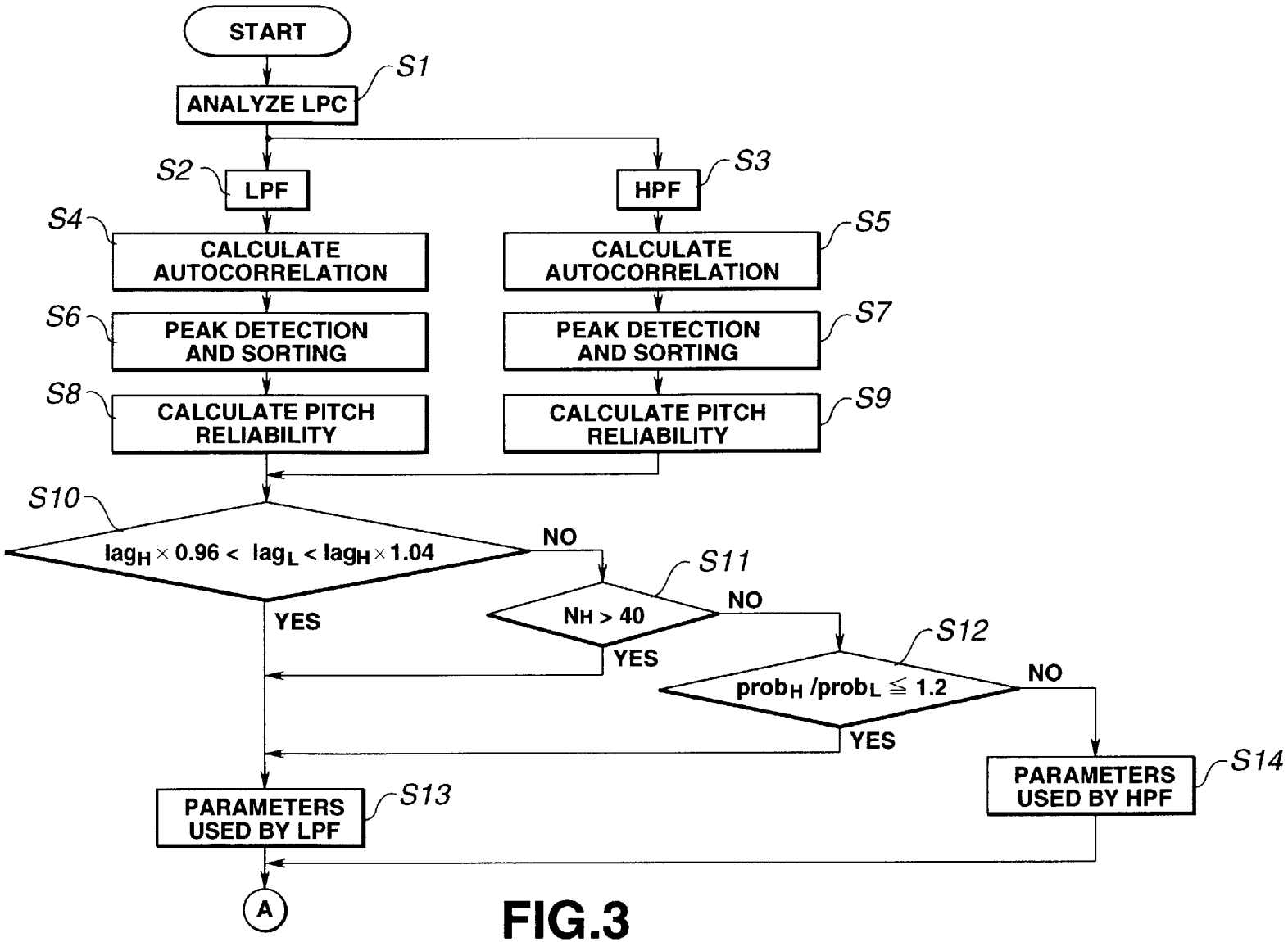
FIG. 3 is a flowchart for illustrating pitch search.

At step S1 of FIG. 3, a pre-set number of speech signals are divided into frames. The resulting frame-based input speech signals are passed through the LPF and HPF at steps S2 and S3 for band limiting, respectively.

Then, at step S4, autocorrelation function data of the band-limited input speech signals are computed. At step S5, autocorrelation data of the input speech signals, band-limited at step S3, are computed.

Using the autocorrelation data, as found at step S4, plural or all peaks are detected at step S6. These peak values are sorted in order to find rH(n) and lagH(n) associated with rH(n). Also, rH(n) is normalized to give a function r'H(n). Using the autocorrelation function data as found at step S5, plural or all peaks are detected at step S7. These peak values are sorted to find lagL(n) and lagL(n). Moreover, the function r'L(0) is obtained by normalizing rL(n).

At step S8, pitch reliability is found using r'H(1) and r'H(2) of r'L(n) as obtained at step S6. On the other hand, pitch reliability is found at step S9 using r'L(1) and r'L(1) among r'L(n) as obtained at step S7.

It is then judged whether the parameter by the LPF or the parameter by the HPF should be used as a parameter for pitch extraction for the input speech signal.

First, it is checked at step S10 whether the value of the pitch lag lagL by the LPF 16 is larger than a value equal to 0.96 times the pitch lag lagH by the HPF 12 and smaller than a value equal to 1.04 times the pitch lag lagH. If the result is YES, processing transfers to step S13 in order to use the parameter obtained based on the autocorrelation data of the input speech signal band-limited by the LPF. If the result is NO, processing transfers to step S11.

At step S11, it is checked whether or not the total number of peaks $N_H$ by HPF is not less than 40. If the result is YES, processing transfers to step S13 in order to use the parameter by LPF. If the result is NO, processing transfers to step S12.

At step S12, it is judged whether or not a value obtained on dividing probH, representing pitch reliability, with probL, is not more than 1.2. If the result of judgment at step S12 is YES, processing transfers to step S13 in order to use the parameter by the LPF. If the result is NO, processing transfers to step S14 in order to use the parameter obtained based on the autocorrelation data of the input speech signal band-limited by the HPF.

Figure 4:
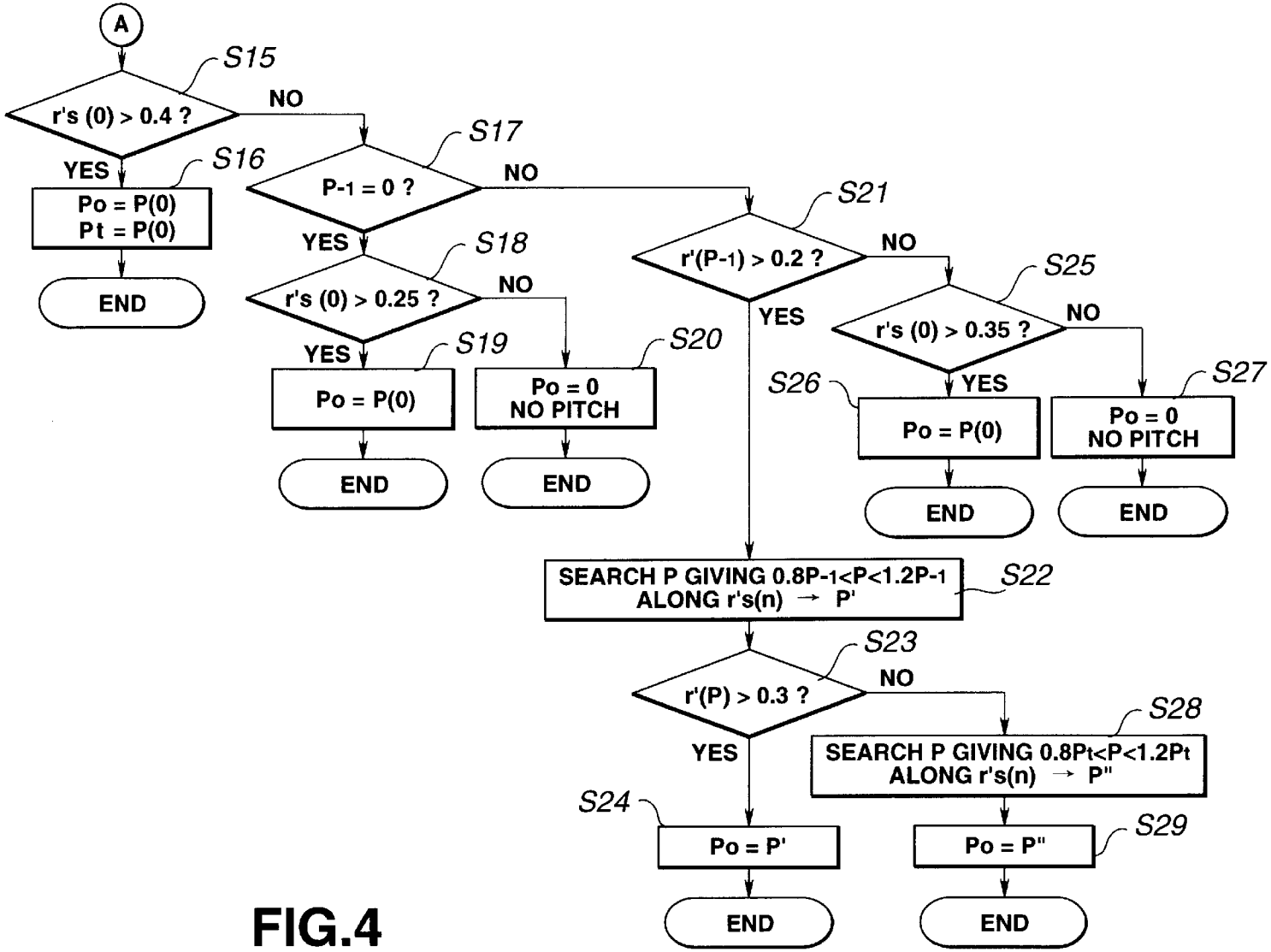
FIG. 4 is a flowchart for pitch search processing subsequent to pitch search processing of FIG. 3.

Using the parameters, thus selected, the following pitch search is executed as shown in FIG. 4. In the following explanation, it is assumed that the autocorrelation data, as the selected parameters, is r(n), the normalized function of the autocorrelation data is r'(n) and a re-arrayed form of this normalized function is r's(n).

At step S15 in the flowchart of FIG. 4, it is judged whether or not the maximum peak r's(0) among the re-arrayed peaks is larger than k=0.4. If the result is YES, that is if the maximum peak r's(0) is larger than 0.4, processing transfers to step S16. If the result is NO, that is if it is found that the maximum peak r's(0) is smaller than 0.4, processing transfers to step S17.

At step S16, P(0) is set as the pitch $P_0$ for the current frame, as a result of a judgment of YES at step S15. At this time, P(0) is set as a typical pitch $P_t$.

At step S17, it is judged whether or not there is no pitch $P_{-1}$ in the previous frame. If the result is YES, that is if it is found that there is no pitch, processing transfers to step S18. If the result is NO, that is if it is found that a pitch is present, processing transfers to step S21.

At step S18, it is judged whether or not the maximum peak value r's(0) is larger than k=0.25. If the result is YES, that is if it is found that the maximum peak value r's(0) is larger than k, processing transfers to step S19. If the result is NO, that is if it is found that the maximum peak value r's(0) is smaller than k, processing transfers to step S20.

At step S19, if the result of step S18 is YES, that is if the maximum peak value r's(0) is larger than k=0.25, P(0) is set as the pitch $P_0$ of the current frame.

At step S20, if the result of step S18 is NO, that is if the maximum peak value r's(0) is smaller than k=0.25, it is determined that there is no pitch in the current frame ($P_0$=P(0)).

At step S21, it is judged, responsive to the result of step S17 that the pitch $P_{-1}$ of the past frame was not 0, that is that there was a pitch in the past frame, whether or not the peak value at the past pitch $P_{-1}$ is larger than 0.2. If the result is YES, that is if the past pitch $P_{-1}$ is larger than 0.2, processing transfers to step S22. If the result is NO, that is if the past pitch $P_{-1}$ is smaller than 0.2, processing transfers to step S25.

At step S22, the maximum peak value r's($P_{-1}$) is searched within a range of 80 to 120% of the pitch $P_{-1}$ of the past frame. That is, r's(n) is searched within a range of $0 \leqq N < j$ for the previously found past pitch $P_{-1}$.

At step S23, it is judged whether or not the candidate for the pitch of the current frame searched at step S22 is larger than a pre-set value 0.3. If the result is YES, processing transfers to step S24 and, if the result is NO, processing transfers to step S28.

At step S24, the candidate of the pitch for the current frame is set, responsive to the result of judgment of YES of step S23, as the pitch of the current frame.

At step S25, it is judged, responsive to the result of step S21 that the peak value r'($P_{-1}$) at the past pitch $P_{-1}$ is smaller than 0.2, whether or not the maximum peak value r's(0) at this time is larger than 0.35. If the result is YES, that is if it is judged that the maximum peak value r's(0) is larger than 0.35, processing transfers to step S26. If the result is NO, that is if it is judged that the maximum peak value r's(0) is smaller than 0.35, processing transfers to step S27.

If the result of step S25 is YES, that is if the maximum peak value r's(0) is larger than 0.35, P(0) is set as the pitch $P_0$ of the current frame.

If the result of step S25 is NO, that is if the maximum peak value r's(0) is smaller than 0.35, it is judged at step S27 that there is no pitch in the current frame.

Responsive to the result at No of step S23, the maximum peak value r's(Pt) is searched for at step S28 within a range of 80 to 120% of the typical pitch Pt. That is, r's(n) is searched in a range of $0 \leqq n < j$ for the previously found typical pitch Pt.

At step S29, the pitch searched at step S28 is set as the pitch $P_0$ of the current frame.

The pitch of the current frame is determined in this manner based on the pitch calculated for the past frame and every band-limited frequency band on the frame basis, in order to compute an evaluation parameter, and the fundamental pitch is determined based on the evaluation parameter. The pitch of the current frame, thus determined from the past frame, is determined based on the pitch of the current frame and a future frame for finding the pitch of the current frame more accurately.

Figure 5:
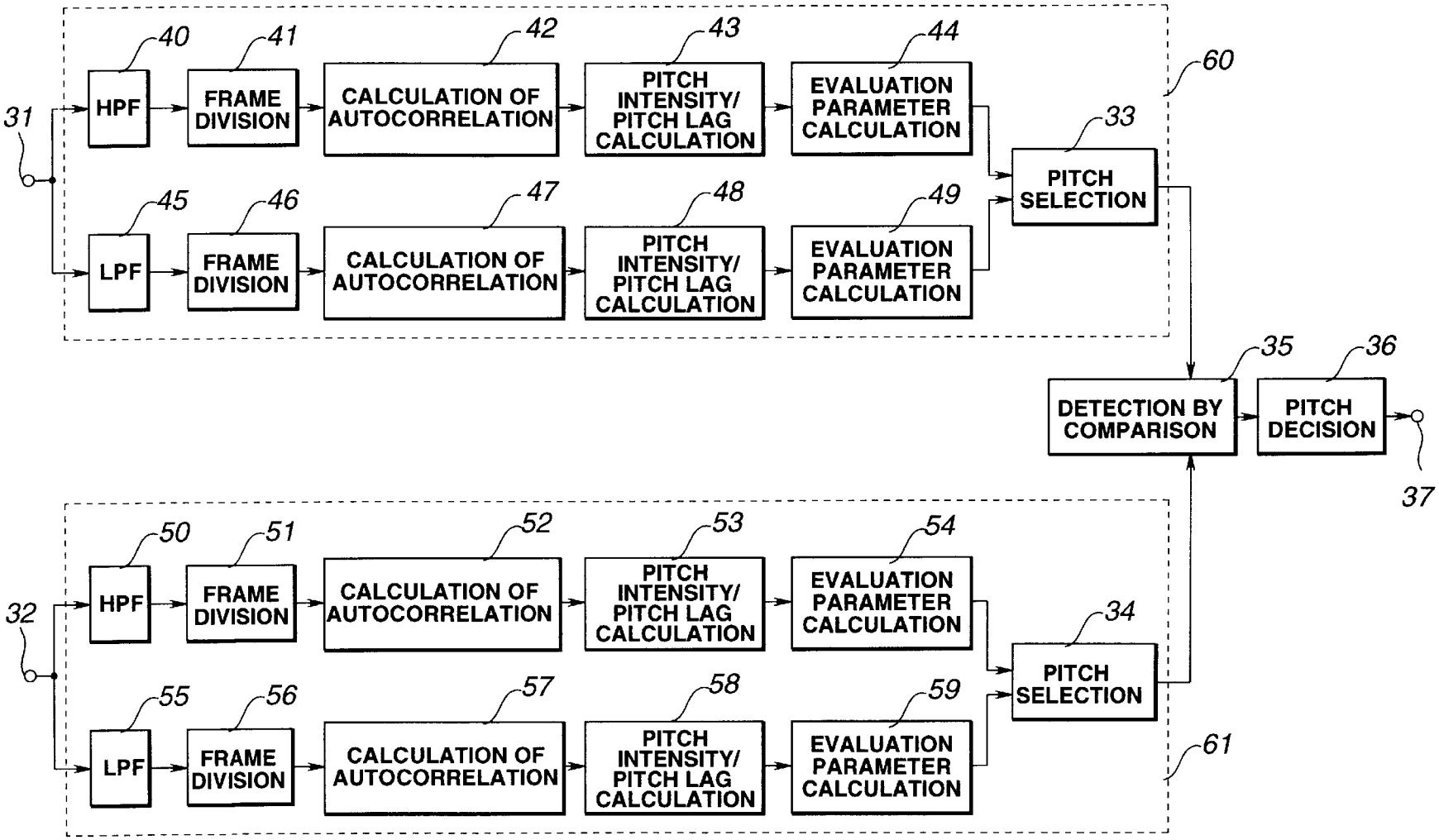
FIG. 5 schematically illustrates another pitch search device.

FIG. 5 shows another embodiment of the pitch search device shown in FIGS. 1 and 2. In the pitch search device of FIG. 5, frequency band limitation of the current frame is done in a current pitch computing unit 60. The input speech signal is divided into frames. The parameters of the frame-based input speech signals are found. Similarly, in the pitch search device of FIG. 5, frequency band limitation of the current frame was done in another current pitch computing unit 61. The input speech signal is divided into frames. The parameters of the frame-based input speech signals are found and the pitch of the current frame is found by comparing these parameters.

Meanwhile, autocorrelation computing units 42, 47, 52, 57 perform processing similar to that of the autocorrelation computing units 13 ,17 of FIG. 2, while pitch intensity/pitch lag computing units 43, 48, 53, 58 perform processing similar to that performed by the pitch intensity/pitch lag computing units 14, 18. On the other hand, evaluation parameter computing units 44, 49, 54, 59 perform processing similar to that performed by the evaluation parameter computing units 15, 19 of FIG. 2 and pitch selection units 33, 34 perform processing similar to that performed by the pitch selection unit 20 of FIG. 2, while a comparator/detector 35 performs processing similar to that performed by the comparator/detector 5 of FIG. 1 and a pitch decision unit 36 performs processing similar to that performed by the pitch decision unit 6 of FIG. 1.

The speech signal of the current frame, inputted from an input terminal 31, is limited in frequency range by an HPF 40 and an LPF 45. The input speech signal is then divided into frames by frame division units 41, 46 so as to be outputted as frame-based input speech signals. The autocorrelation data is then computed in the autocorrelation computing units 42, 47, while pitch intensity/pitch lag computing units 43, 48 compute the pitch intensity and the pitch lag. The comparative values of the pitch intensity, as evaluation parameters, are computed in evaluation parameter computing units 44, 49. The pitch selector 33 then selects, using the pitch lag or the evaluation parameters, one of two parameters, that is a parameter of the input speech signal band-limited by the HPF 40 or a parameter of the input speech signal band-limited by the LPF 45.

Similarly, the speech signal of the other frame, inputted from an input terminal 32, is limited in frequency range by an HPF 50 and an LPF 55. The input speech signal is then divided into frames by frame division units 51, 56 so as to be outputted as frame-based input speech signals. The autocorrelation data is then computed in the autocorrelation computing units 52, 57, while pitch intensity/pitch lag computing units 53, 58 compute the pitch intensity and the pitch lag. In addition, the pitch intensity and the pitch lag are computed in pitch intensity/pitch lag computing units 53, 58. The comparative values of the pitch intensity, as evaluation parameters, are computed in evaluation parameter computing units 54, 59. The pitch selector 34 then selects, using the pitch lag or the evaluation parameters, one of two parameters, that is a parameter of the input speech signal band-limited by the HPF 50 or a parameter of the input speech signal band-limited by the LPF 55.

The comparator/detector 35 compares the peak pitch as detected by the current frame pitch computing unit 60 to the pitch as calculated by the other current pitch computing unit 61 in order to check to see whether or not the two values are within a pre-set range, and detects the peak when the result of comparison is within this range. The pitch decision unit 36 decides the pitch of the current frame from the peak pitch detected on comparison by the comparator/detector 35.

Meanwhile, the frame-based input speech signal may be processed with linear predictive coding (LPC) to produce short-term prediction residuals, that is linear predictive coding residuals (LPC residuals) which may then be used for calculating the pitch for realizing more accurate pitch extraction.

The decision processing and the constants used for the decision processing are merely illustrative, such that constants or decision processing other than that shown in Table 1 may be used for selecting more accurate parameters.

In the above-described pitch extraction device, the frequency spectrum of the frame-based speech signals is limited to two frequency bands, using an HPF and al LPF, for selecting an optimum pitch. However, the number of the frequency bands need not be limited to two. For example, it is also possible to limit the frequency spectrum to three or more different frequency bands and to compute pitch values of speech signals of the respective frequency bands in order to select the optimum pitch. At this time, another illustration of decision processing for selecting parameters of the input speech signals of the three or more different frequency bands is used in place of performing the decision processing shown in Table 1.

Figure 6:
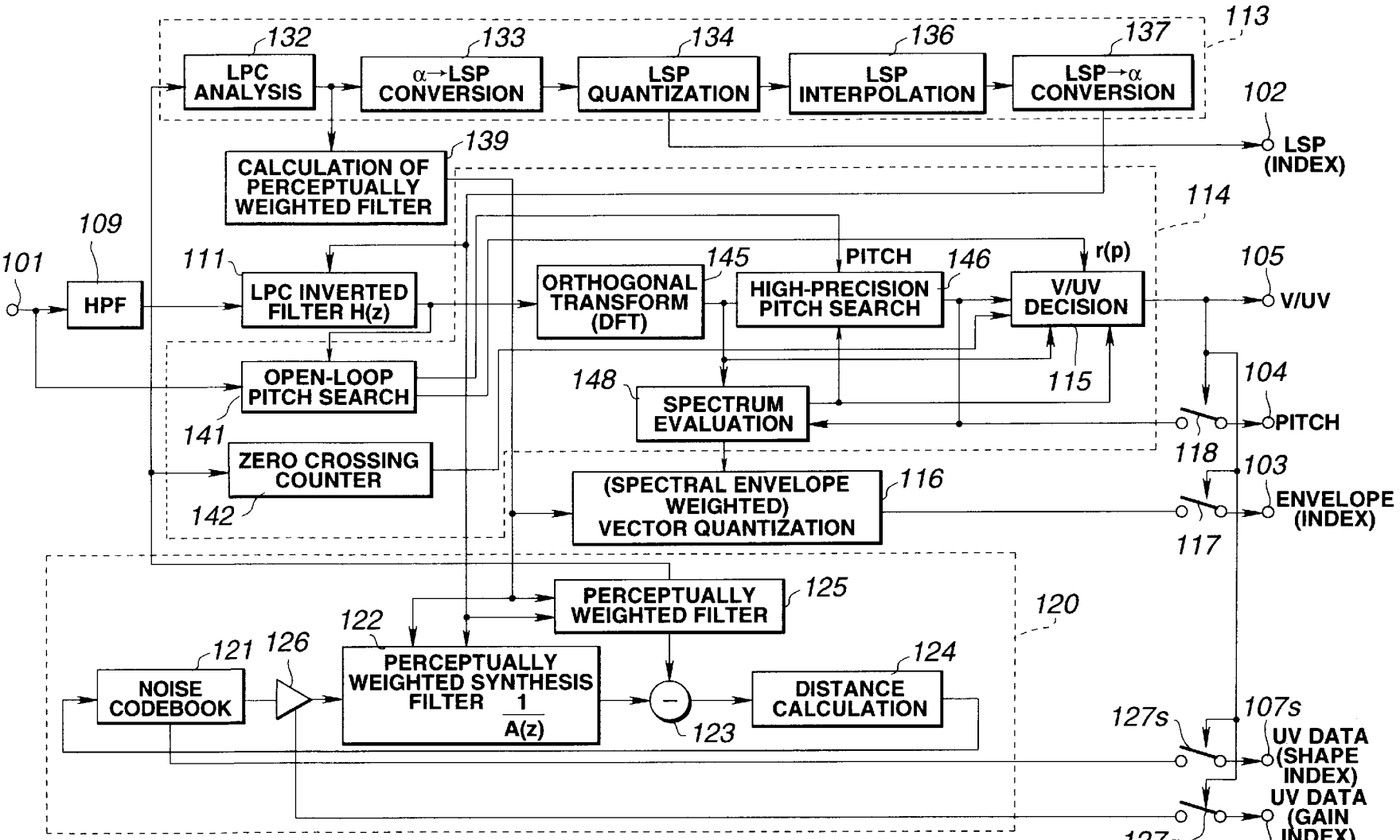
FIG. 6 schematically illustrates a speech signal encoder employing a pitch search device according to the present invention.

An embodiment of the present invention, in which the above-described pitch search device is applied to a speech signal encoder, is now explained by referring to FIG. 6.

The speech signal encoder, shown in FIG. 6, finds short-term prediction residuals of input speech signals, for example, the LPC residuals, effectuates sinusoidal analysis encoding, such as harmonic encoding, encodes the input speech signal by phase transmission waveform coding and encodes the voiced (V) portion and the unvoiced (UV) portion of the input speech signal.

In the speech encoder, shown in FIG. 6, the speech signal, supplied to an input terminal 101, is filtered by a high-pass filter (HPF) 109 for removing signals of an unneeded band before being sent to an LPC analysis circuit 132 of an LPC analysis quantization unit 113 and to an LPC inverted filter circuit 111.

The LPC analysis circuit 132 of the LPC analysis quantization unit 113 applies a Hamming window to an input waveform signal, with a length of the input waveform signal of the order of 256 samples as a block, in order to find a linear prediction coefficient, or a so-called $\alpha$ parameter, by the autocorrelation method. The framing interval, as a data outputting unit, is set to approximately 160 samples. If the sampling frequency fs is 8 kHz, for example, the frame interval is 160 samples or 20 msec.

The $\alpha$ parameters from the LPC analysis circuit 132 are sent to LSP conversion circuit 133 for conversion to linear spectral pair (LSP) parameters. This converts the $\alpha$ parameters found as direct type filter coefficients, into, for example, parameters, that is five pairs of, LSP parameters. This conversion is effected by, for example, the Newton-Rhapson method. The reason of converting the $\alpha$ parameters to the LSP parameters is that the LSP parameters are superior to the $\alpha$ parameters in interpolation characteristics.

The LSP parameters from the a to LSP conversion circuit 133 are matrix quantized by an LSP quantizer 134. It is possible to find the frame-to-frame difference before proceeding to vector quantization, or to collect plural frames together in order to effect matrix quantization. In the present embodiment, 2 frames of the LSP parameters computed every 20 msec, with 20 msec being a frame, are collected together to effect vector- or matrix quantization thereon.

The quantized output of the LSP quantizer 134, that is the indices for LSP quantization, is taken out at a terminal 102, while the quantized LSP vector is sent to an LSP interpolation circuit 136.

The LSP interpolation circuit 136 interpolates the LSP vectors, quantized every 20 msec or every 40 msec, as described above, for providing an octatuple rate. That is, the LSP vectors are updated every 2.5 msec. The reason is that, if the residual waveform is analysis-synthesized by a harmonic encoding/decoding method, the envelope of the synthesized waveform presents an extremely smooth waveform, so that, if the LPC coefficients are varied abruptly every 20 msec, an alien sound tends to be produced. That is, if the LPC coefficients are varied gradually every 2.5 msec, such alien sound can be prevented from being produced.

For effecting inverted filtering, using the interpolated 2.5 msec based LSP vectors, the LSP parameters are converted by an LSP to α conversion circuit 137 into α parameters, which are for example 10-order direct type filter coefficients. An output of the LSP to α conversion circuit 137 is sent to a perceptual weighting filter computing circuit 139 to find data for perceptual weighting. This weighting data is sent to a perceptually weighted vector quantizer 116 as later explained and to a perceptually weighting filter 125 and to a perceptually weighted synthesis filter 122 of a second encoding unit 120.

The sinusoidal analysis encoding unit 114, such as a harmonic encoding circuit, analyzes the output of the LPC inverted filter 111 by an encoding method, such as harmonic encoding. That is, the sinusoidal analysis encoding unit 114 detects the pitch, computes the amplitude Am of each harmonic, discriminates the voiced (V)/unvoiced (UV) and converts the envelope of the harmonics changed with the pitch, or the number of the amplitudes Am, to a constant number by dimensional conversion.

In the illustrative example of the sinusoidal analysis/encoding unit 114, shown in FIG. 6, it is presupposed that the encoding is the usual harmonic encoding. In the case of multi-band excitation encoding (MBE), modeling is done on the assumption that there exist voiced and unvoiced portions in each frequency band of the same time instant (same block or frame). In other harmonic encoding, an alternative decision is made as to whether the speech in a block or frame is the voiced speech or the unvoiced speech. Meanwhile, in the following description, the frame-based V/UV decision is made so that, if the totality of bands are UV in the case of MBE, such frame is deemed to be UV.

To an open loop pitch search unit 141 and to a zero-crossing counter 142 of the sinusoidal analysis/encoding unit 114, shown in FIG. 6, there are supplied the input speech signal from the input terminal 101 and a signal from the HPF 109, respectively. To an orthogonal transform circuit 145 of the sinusoidal analysis/encoding unit 114 are supplied the LPC residuals or linear prediction residuals from the LPC inverted filter 111. This open loop pitch search unit 141 uses an embodiment of the above-described pitch search device of the present invention. The open loop pitch search unit 141 takes the LPC residuals of the input signal in order to effect a rougher pitch search using an open loop search. The extracted rough pitch data is sent to a high precision pitch search unit 146 in order to effect a high-precision pitch search by a closed loop search as will be explained subsequently. From the open loop pitch search unit 141, a normalized maximum autocorrelation value r(p), obtained on normalizing the autocorrelation of the LPC residuals with power, is taken out along with the above-mentioned rough pitch data, so as to be sent to a voiced/unvoiced (V/UV) decision unit 115.

The orthogonal transform circuit 145 effects an orthogonal transform, such as a discrete cosine transform (DCT), for converting the time-domain LPC residuals into frequency-domain spectral amplitude data. Outputs of the orthogonal transform circuit 145 are sent to the high precision loop pitch search unit 146 and to a spectrum evaluation unit 148 used for evaluating the spectral amplitudes or the envelope.

The high precision loop pitch search unit 146 is fed with the rougher pitch data extracted by the open loop pitch search unit 141 and with the frequency-domain data transformed by, for example, DFT, by the orthogonal transform circuit 145. The high precision loop pitch search unit 146 effects a swinging search of several samples, at an interval of 0.2 to 0.5 samples, with the rough pitch data value as center, for arriving at fine pitch data with an optimum decimal point (floating). As the fine search technique, a so-called analysis by synthesis method is used in order to select a pitch so that the synthesized power spectrum is closest to the power spectrum of the original sound. The pitch data from the high precision loop pitch search unit 146 the closed loop pitch search is sent via a switch 118 to an output terminal 104.

A spectrum evaluation unit 148 evaluates the size of each harmonic and the spectral envelope as the assembly of the entire harmonics, based on the spectral amplitudes of the orthogonal transform outputs of the LPC residuals and the pitch, and sends the result to the voiced/unvoiced (V/UV) decision unit 115 and to the perceptually weighted vector quantizer 116.

The voiced/unvoiced (V/UV) decision unit 115 performs a V/UV decision for a frame based on an output of the orthogonal transform circuit 145, an optimum pitch from the high precision loop pitch search unit 146, spectra amplitude data from the spectrum evaluation unit 148, the normalized maximum autocorrelation value r(p) from the open loop search unit 141 and the crossing count value from the zero-crossing counter 142. The boundary position of the results of band-based V/UV discrimination may also be used as a condition for the V/UV decision for the frame. The decision output from the V/UV decision unit 115 is taken out via output terminal 105.

An output unit of the spectrum evaluation unit 148 or an input unit of the vector quantizer 116 are provided with a data number conversion unit (a sort of sampling rate conversion unit). This data number conversion unit is used for assuring a constant number of envelope amplitude data |Am| in consideration that the number of divisions of bands on the frequency axis varies with the pitch and hence the number of data is varied. That is, if the effective band is up to 3400 kHz, the effective band is divided into 8 to 63 bands, depending on the pitch, such that the number mMx+1 of the amplitude data |Am|, obtained from band to band, is varied in a range from 8 to 63 bands. Therefore, the data number conversion unit converts the variable number mMx+1 of the amplitude data to a pre-set number M, such as 44.

The pre-set number, such as 44, of the amplitude data or the envelope data from the data number conversion unit provided at the output of the spectrum evaluation unit 148 or the input of the vector quantizer 116, are grouped by the vector quantizer 116 into units each made up of a pre-set number, such as 44, of data, and processed with weighted vector quantization. The weight is supplied by an output of the perceptual weighting filter computing circuit 139. The index data of the envelope from the vector quantizer 116 is taken out via switch 117 at an output terminal 103. Prior to the above weighted vector quantization, a frame-to-frame difference may be taken of the vector made up of a pre-set number of data using appropriate leak coefficients.

The second encoding unit 120 is now explained. The second encoding unit 120 has a so-called code excited linear prediction (CELP) encoding structure, and is used in particular for encoding the unvoiced portion of the input speech signal. In the CELP encoding structure for the unvoiced portion, a noise output corresponding to the LPC residuals of the unvoiced speech, as a representative value output of a noise codebook, or a so-called stochastic codebook 121, is sent via a gain circuit 126 to a perceptually weighted synthesis filter 122. The perceptually weighted synthesis filter 122 LPC-synthesizes the input noise to send the resulting weighted unvoiced signal to a subtractor 123. The subtractor 123 is fed with a signal corresponding to a speech signal supplied from the input terminal 101 via a high-pass filter (HPF) 109 and perceptually weighted by the perceptually weighting filter 125, for outputting a difference or error thereof from the signal from the synthesis filter 122. This error is sent to a distance computing circuit 124 for computing the distance and a representative value vector which will minimize the error and is searched by the noise codebook 121. In this manner, the time-axis waveform is vector-quantized using a closed-loop search employing an analysis by synthesis method.

As data for the unvoiced (UV) portion from the second encoding unit 120 employing the CELP encoding structure, the shape index of the codebook from the noise codebook 121 and the gain index of the codebook from the gain circuit 126 are taken out. The shape index, as UV data from the noise codebook 121, is sent via switch 127*s* to an output terminal 107*s*, while the gain index as UV data of the gain circuit 126 is sent via switch 127*g* to an output terminal 107*g*.

The switches 127*s*, 127*g* and the switches 117, 118 are on/off controlled based on the results of the V/UV decision from the V/UV decision unit 115. The switches 117, 118 are turned on when the result of the V/UV decision of the speech signal of the frame currently transmitted is voiced (V), while the switches 127*s*, 127*g* are turned on when the result of the V/UV decision of the speech signal of the frame currently transmitted is unvoiced (UV).

What is claimed is:

1. A pitch extraction apparatus comprising:

signal division means for dividing an input signal into a plurality of units, each unit having a pre-set number of samples;

filter means for limiting the input speech signal which has been divided into said plurality of units to a plurality of different frequency bands;

autocorrelation computing means for computing autocorrelation data of one of said plurality of units of the speech signal in each of said plurality of frequency bands of said filter means;

pitch period computing means detecting a plurality of peak values from the autocorrelation data in each of said plurality of frequency bands to find a pitch intensity for computing a pitch period;

evaluation parameter computing means for computing an evaluation parameter specifying a reliability of the pitch intensity found by the pitch period computing means based on a comparison of two of said plurality of peak values; and pitch selection means for selecting a pitch of the speech signal in one of said plurality of frequency bands based on the pitch period from said pitch period computing means and on the evaluation parameter from said evaluation parameter computing means.

2. The pitch extraction apparatus as claimed in claim 1 wherein said evaluation parameter computing means includes means for computing a comparative value of said pitch intensity based on two peak values of the autocorrelation data.

3. The pitch extraction apparatus as claimed in claim 1 wherein said filter means includes a high-pass filter and a low-pass filter for limiting the input speech signal to two frequency bands.

4. The pitch extraction apparatus as claimed in claim 1 wherein said input speech signal fed to said filter means is a frame-based speech signal.

5. The pitch extraction apparatus as claimed in claim 1 wherein said filter means includes at least one low-pass filter.

6. The pitch extraction apparatus as claimed in claim 5 wherein said filter means includes a low-pass filter for outputting a signal void of high-frequency components and for outputting the input speech signal fed thereto.

7. The pitch extraction apparatus as claimed in claim 6 wherein said filter means includes a high-pass filter and a low-pass filter for outputting the speech signal limited to two frequency bands.

8. The pitch extraction apparatus as claimed in claim 1 wherein said filter means includes means for outputting the input speech signal limited to the plurality of frequency bands on the frame basis.

9. The pitch extraction apparatus as claimed in claim 8 wherein said filter means includes a high-pass filter and a low-pass filter for outputting the speech signal limited to two frequency bands on a frame basis.

10. A pitch extraction method comprising:

a signal division step for dividing an input speech signal into a plurality of units, each unit having a pre-set number of samples;

a filtering step for limiting the input speech signal to a plurality of different frequency bands;

an autocorrelation computing step for computing autocorrelation data of one of said plurality of units of the speech signal in each of said plurality of frequency bands;

a pitch period computing step for detecting a plurality of peak values from the autocorrelation data in each of said plurality of frequency bands to find a pitch intensity for computing a pitch period;

an evaluation parameter computing step for computing an evaluation parameter specifying reliability of the pitch intensity based on a comparison of two of said plurality of peak values; and a pitch selection step for selecting a pitch of the speech signal of one of said frequency bands based on the pitch period and the evaluation parameter.

11. The pitch extraction method as claimed in claim 10 wherein said evaluation parameter computing step includes computing a comparative value of said pitch intensity based on two peak values of the autocorrelation data.

12. The pitch extraction method as claimed in claim 10 wherein said filtering step includes outputting a speech signal limited to two frequency bands using a high-pass filter and a low-pass filter.

13. A pitch extraction apparatus comprising:

filter means for limiting an input speech signal to a plurality of different frequency bands;

autocorrelation computing means for computing autocorrelation data of the speech signal in each of said plurality of frequency bands of said filter means;

pitch period computing means detecting a plurality of peak values from the autocorrelation data in each of said plurality of frequency bands to find a pitch intensity for computing a pitch period;

evaluation parameter computing means for computing an evaluation parameter specifying a reliability of said pitch intensity found by said pitch period computing means based on said plurality of peak values; and pitch selecting means for selecting a pitch of the speech signal in one of said plurality of frequency bands based on said pitch period from said pitch period computing means and on said evaluation parameter from said evaluation parameter computing means.

14. The pitch extraction apparatus as claimed in claim 13 wherein said pitch period computing means includes means for determining a pitch lag value in each of said plurality of frequency bands, each pitch lag value being a corresponding number of samples per pitch period which is calculated based on said plurality of peak values, said evaluation parameter means includes means for determining a pitch reliability ratio of two peak values from said plurality of peak values in each of said plurality of frequency bands, and said pitch selecting means selects a pitch of the speech signal in one of said plurality of frequency bands based on at least one of a first comparison of the pitch lag values of said plurality of respective frequency bands and a second comparison of the pitch reliability ratios of said plurality of respective frequency bands.

15. The pitch extraction apparatus as claimed in claim 14 wherein said filter means includes a high-pass filter and a low-pass filter for outputting the speech signal limited to a higher frequency band and a lower frequency band, respectively, and said pitch selecting means selects a pitch of the speech signal in one of said higher and lower frequency bands based on at least one of a first comparison of the pitch lag values of said respective higher and lower frequency bands, a number of peak values in said higher frequency band, and a second comparison of the pitch reliability ratios of said respective higher and lower frequency bands.

16. The pitch extraction apparatus as claimed in claim 15 wherein said pitch selecting means selects a pitch of the speech signal in said lower frequency band if a ratio of the pitch lag value of said lower frequency band to the pitch lag value of said higher frequency band is greater than a first predetermined ratio and less than a second predetermined ratio, or else if said number of peak values in said higher frequency band is greater than a predetermined threshold number, and said pitch selecting means selects a pitch of the speech signal in said higher frequency band if a ratio of the pitch reliability of said higher frequency band to the pitch reliability of said lower frequency band is greater than a third predetermined ratio.

17. A pitch extraction method comprising:

a filtering step for limiting an input speech signal to a plurality of different frequency bands;

an autocorrelation computing step for computing autocorrelation data of the speech signal in each of said plurality of frequency bands;

a pitch period computing step for detecting a plurality of peak values from the autocorrelation data in each of said plurality of frequency bands to find a pitch intensity for computing a pitch period;

an evaluation parameter computing step for computing an evaluation parameter specifying a reliability of the pitch intensity based on said plurality of peak values; and a pitch selection step for selecting a pitch of the speech signal of one of said frequency bands based on the pitch period and the evaluation parameter.

18. The pitch extraction apparatus as claimed in claim 17 wherein said pitch period computing step further includes determining a pitch lag value in each of said plurality of frequency bands, each pitch lag value being a corresponding number of samples per pitch period which is calculated based on said plurality of peak values, said evaluation parameter step further includes determining a pitch reliability ratio of two peak values from said plurality of peak values in each of said plurality of frequency bands, and a pitch of the speech signal of one of said frequency bands is selected in said pitch selecting step based on at least one of a first comparison of the pitch lag values of said plurality of respective frequency bands and a second comparison of the pitch reliability ratios of said plurality of respective frequency bands.

19. The pitch extraction apparatus as claimed in claim 18 wherein said filter step includes outputting the speech signal limited to a higher frequency band and a lower frequency band using a high-pass filter and a low-pass filter, respectively, and said pitch selecting step selects a pitch of the speech signal in one of said higher and lower frequency bands based on at least one of a first comparison of the pitch lag values of said respective higher and lower frequency bands, a number of peak values in said higher frequency band, and a second comparison of the pitch reliability ratios of said respective higher and lower frequency bands.

20. The pitch extraction apparatus as claimed in claim 19 wherein a pitch of the speech signal in said lower frequency band is selected in said pitch selecting step if a ratio of the pitch lag value of said lower frequency band to the pitch lag value of said higher frequency band is greater than a first predetermined ratio and less than a second predetermined ratio, or else if said number of peak values in said higher frequency band is greater than a predetermined threshold number, and a pitch of the speech signal in said higher frequency band is selected in said pitch selecting step if a ratio of the pitch reliability of said higher frequency band to the pitch reliability of said lower frequency band is greater than a third predetermined ratio.

* * * * *